United States Patent [19]

Umezawa

[11] 4,451,169

[45] May 29, 1984

[54] PAPER LOADING APPARATUS

[75] Inventor: Michio Umezawa, Kanagawa, Japan

[73] Assignee: Ricoh Company, Ltd., Japan

[21] Appl. No.: 310,288

[22] Filed: Oct. 9, 1981

[30] Foreign Application Priority Data

Oct. 14, 1980 [JP] Japan ..... 55-144140
Oct. 15, 1980 [JP] Japan ..... 55-144119

[51] Int. Cl.[3] ..... B41J 13/28

[52] U.S. Cl. ..... 400/631; 400/637; 400/662

[58] Field of Search ..... 400/630, 631, 632, 661.3, 400/632.1, 636, 637, 637.1, 641, 659, 608, 608.1, 608.2, 605, 708, 708.1, 670.1, 662

[56] References Cited

U.S. PATENT DOCUMENTS

| | | | |
|---|---|---|---|
| 847,428 | 3/1907 | McCormack | 400/631 |
| 1,192,577 | 7/1916 | Smith | 400/637 |
| 2,389,813 | 11/1945 | Pfeiffer | 400/636 X |
| 3,664,481 | 5/1972 | Dreimanis et al. | 400/636 X |
| 4,173,420 | 11/1979 | Okabe | 400/608.1 X |

FOREIGN PATENT DOCUMENTS

| | | | |
|---|---|---|---|
| 126470 | 9/1980 | Japan | 400/631 |

OTHER PUBLICATIONS

IBM Technical Disclosure Bulletin, vol. 17, No. 5, Oct. 1975, pp. 1263-1264, "Paper Table Actuated Feed Rollers & Paper Gate" by Klein et al.

*Primary Examiner*—Edgar S. Burr
*Assistant Examiner*—Charles A. Pearson
*Attorney, Agent, or Firm*—Guy W. Shoup; Eliot S. Gerber

[57] ABSTRACT

A paper loading apparatus includes a paper retaining roller and a stop claw, both arranged for movement toward or away from a platen in opposite directions from each other. When the stop claw bears against the platen, paper is inserted into the apparatus and is properly held by the claw. Subsequently, the paper retaining roller is brought into abutment against the platen, whereupon the stop claw is moved away from the platen. The movement of the roller and the stop claw toward or away from the platen occurs automatically in response to a detection signal which indicates the insertion of the paper into the apparatus. In one embodiment, the platen is peripherally formed with a plurality of axially spaced annular grooves which extend in a direction perpendicular to the axis thereof, and receive protuberances formed on the free end of the stop claw.

1 Claim, 6 Drawing Figures

PAPER LOADING APPARATUS

BACKGROUND OF THE INVENTION

The invention relates to a paper loading apparatus which may be used in a typewriter, printer or the like. In a typewriter, for example, print paper on which a record is to be made is loaded on the surface of a platen, and either the platen or a print head moves reciprocately while the platen rotates intermittently to perform a printing operation. If the paper is loaded askew of the platen, the printed lines will be also oriented askew. Hence, when loading the paper on the platen, the paper must be loaded so as to be located parallel to the axis of the platen. In the prior art practice, after the paper has been once loaded on the platen, a paper retaining roller is released and both the leading and the trailing edge of the paper are brought into superimposed relationship to achieve the parallelism, whereupon the roller is again moved into abutment against the platen. This is a troublesome operation to perform. To avoid such difficulty by allowing the parallelism of the paper to be achieved in a single operation, a stop claw may be disposed below the paper retaining roller. The paper is inserted while the roller is released from its loading position, until the leading end of the paper moves into abutment against the stop claw to achieve the parallelism, whereupon the roller is brought into abutment against the platen while moving the stop claw away from the platen.

SUMMARY OF THE INVENTION

It is an object of the invention to provide an improvement in a paper loading apparatus of the type described which is provided with a stop claw, and the invention resides in the provision of controlling the movement of the paper retaining roller and the stop claw toward or away from the surface of the platen in response to an electrical signal from means which detect the insertion of the paper into the apparatus.

In one embodiment of the invention, the paper retaining roller is normally disposed in abutment against the platen while the stop claw is kept away from the platen. In response to a detection signal which indicates the insertion of the paper, the roller is automatically moved away from the platen while the stop claw is moved into abutment against the platen. When the leading end of the paper inserted bears against the stop claw to achieve the parallelism of the paper with respect to the platen, the detection signal is manually terminated, allowing both the roller and the claw to return to their normal positions.

In another embodiment of the invention, the paper retaining roller is normally kept away from the platen while the stop claw is normally disposed in abutment against the platen. In response to a detection signal which now indicates the fact that the leading edge of the paper bears against the stop claw, the roller is automatically brought into abutment against the platen while the stop claw is moved away from the platen.

It is another object of the invention to provide a paper loading apparatus which facilitates a paper loading operation.

It is another object of the invention to provide a paper loading apparatus of the type described in which the movement of the paper retaining roller and the stop claw toward or away from the platen is automatically controlled in accordance with a detection signal which indicates the insertion of paper into the apparatus.

Above and other objects and advantages of the invention will become apparent from the following description with reference to the drawings.

DESCRIPTION OF EMBODIMENTS

Figure 1:
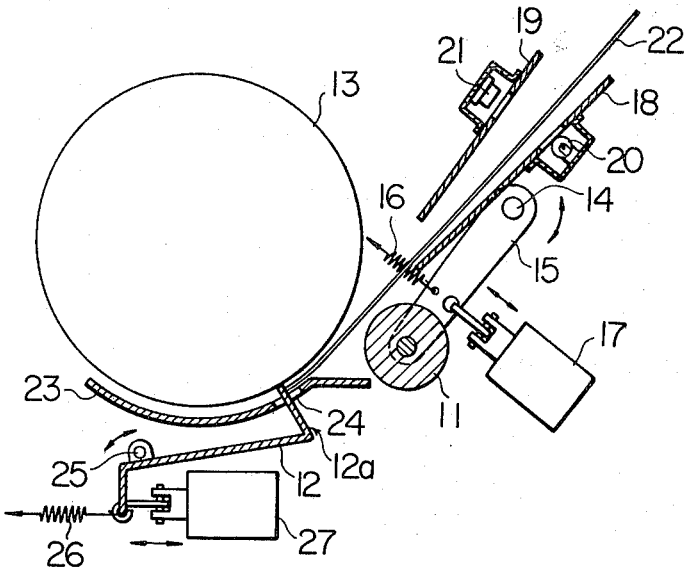
FIG. 1 is a schematic view illustrating a paper loading apparatus according to one embodiment of the invention.

Referring to FIG. 1, there is schematically shown one embodiment of the invention. A paper retaining roller 11 and a stop claw 12 are disposed so as to be movable toward or away from the surface of a platen 13. The roller 11 is rotatable mounted on the free end of an arm 15 which is in turn pivotally mounted on a pin 14. The roller 11 is normally urged by a spring 16 extending between the arm 15 and a pin, not shown, into abutment against the surface of the platen 13, but is moved away therefrom in response to a signal which actuates a solenoid 17. A pair of vertically spaced guide plates 18, 19 are located above the roller 11 and have their lower ends disposed into the space between the roller 11 and the platen 13. A light emitting diode 20 is mounted on the lower guide plate 18 while a light receiving element 21 is mounted on the upper guide plate 19, and these elements cooperate together to detect the passage of paper 22 between these guide plates 18, 19. Alternatively, a microswitch may be used. The stop claw 12 has an upper hook end **12*a* and is rockably mounted on a pin 25 so that the hook end 12*a* can move through an opening 24 formed in a guide plate 23 which is disposed along the surface of the platen 13. The claw 12 is normally urged by a spring 26 connected to the other end thereof in a manner such that the free edge of the hook end 12*a* is removed from the surface of the platen 13. However, when a solenoid 27 is actuated by a signal, the claw rocks in the opposite direction to move the hook end 12*a* into abutment against the surface of the platen 13 to prevent paper from passing between the platen 13 and the guide plate 23**.

In operation, when the paper 22 is initially inserted into the space between the guide plates 18, 19, the cooperation between the elements 20, 21 immediately detects this fact, and produces an output signal which energizes the solenoids 17, 27, whereupon the roller 11 is moved away from the surface of the platen 13 while the hook end of the stop claw 12 is brought into abutment against the surface of the platen 13. Consequently, a movement of the paper 22 is permitted to the extent that its leading edge moves past the roller 11 to bear against the hook end **12*a* of the stop claw 12. Since the hook end 12*a* of the stop claw 12 extends in a direction parallel to the axis of the platen 13**, if the leading edge bears against the hook end 12*a* of the claw 12 over its entire length, it follows that the leading edge of the paper 22 is disposed parallel to the axis of the platen 13. Stated differently, the paper 22 is manually held into abutment against the stop claw 12 so that the full length of the leading edge thereof bears against the hook end 12*a*. Subsequently, the paper 22 is adjusted in position axially of the platen, and then the solenoids 17, 27 may be deenergized as by operating a button switch, for example. Thereupon, the roller 11 is brought into abutment against the platen 13 with the paper 22 interposed therebetween while the hook end of the stop claw 2 retracts from the paper passage defined between the platen 13 and the guide plate 23, thus loading the paper 22 in place around the platen 13. Thereafter, a rotation of the platen 13 conveys the loaded paper to a given printing position preparatory to the initiation of a printing operation.

Figure 2:
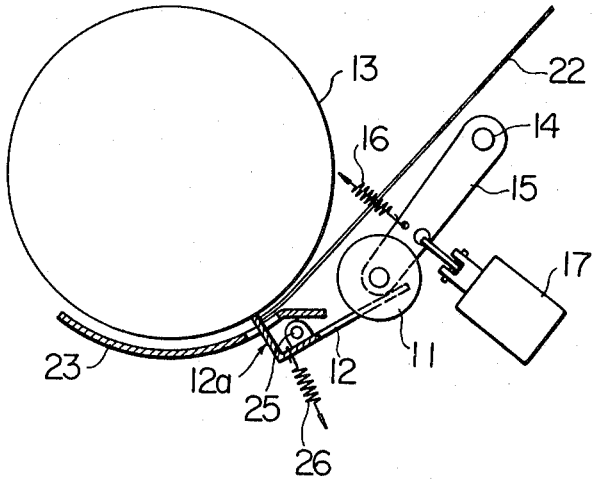
FIG. 2 is a schematic view of a paper loading apparatus according to another embodiment of the invention.

FIG. 2 shows another embodiment of the invention which represents an improvement of the arrangement shown in FIG. 1. This arrangement differs from the embodiment of FIG. 1 in that a stop claw 12 extends in the opposite direction or toward a roller 11, and its end remote from the hook end is held in abutment against the free end of an arm 15 under the resilience of a spring 26. The roller 11 is rotatably mounted on the free end of an arm 15 as before, and is normally urged into abutment against the surface of a platen 13 by the resilience of a spring 16. Consequently, whenever the roller 11 abuts against the platen 13, the hook end of the claw 12 is removed from the surface of the platen 13 inasmuch as the claw 12 is normally pulled by the spring 26. In response to a signal from a paper detector, not shown, which is applied to the solenoid 17, the roller 11 is moved away from the surface of the platen while the hook end of the stop claw 12 is permitted to abut against the surface of the platen. Under this condition, the leading edge of the paper 22 may be held in bearing relationship with the hook end 12*a* of the stop claw 12 to achieve the parallelism of the paper 22, whereupon the solenoid 17 may be deenergized. This allows the roller 11 to abut against the surface of the platen 13 with the roller paper 22 interposed therebetween while the hook end of the stop claw 12 moves away from the surface of the platen. It will be seen that this embodiment achieves a similar effect as that achieved in the arrangement of FIG. 1 with a single solenoid.

Figure 3:
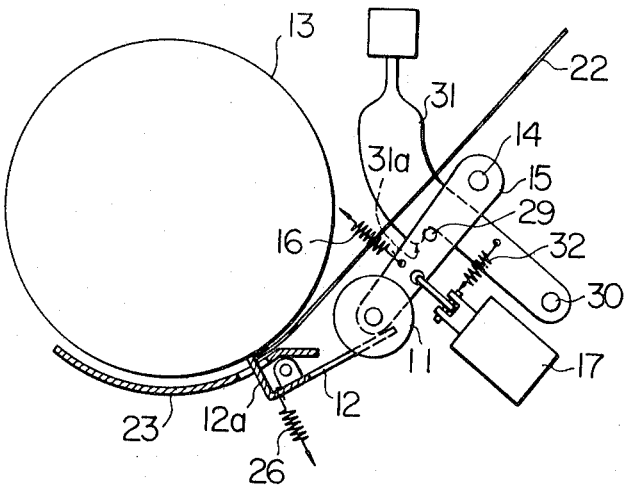
FIG. 3 is a schematic view of a paper apparatus according to a further embodiment of the invention.

FIG. 3 shows a further embodiment of the invention which also represents a further improvement of the arrangement shown in FIG. 2. In the arrangement of FIG. 2, the solenoid 17 must be maintained energized to pull the roller 11 away from the platen during the time the leading edge of the paper 22 is brought into bearing relationship with the hook end of the stop claw 12 in order to achieve the parallelism, thus causing a wasteful power dissipation. In the embodiment of FIG. 3, an arm 15 is provided with a pin 29 intermediate its length, which is adapted to engage a step 31*a*, formed in one lateral edge of the operating lever 31 rockably mounted on a pin 30, as the roller 11 moves away from the platen 13. The operating lever 31 is normally urged by a spring 32 to move counterclockwise. Consequently, after the pin 29 has engaged the step 31*a*, the roller 11 cannot be allowed to move toward the platen 13 if the solenoid 17 is deenergized. Thus, it is only necessary that a pulse signal be supplied to the solenoid 17 to initiate its operation. As a result, the power dissipation is reduced inasmuch as the parallelism of the paper 22 can be achieved during the time the solenoid 17 remains deenergized. Subsequently, the operating lever 31 may be turned clockwise to disengage the step 31*a* from the pin 29, whereupon the roller 11 is allowed to move into abutment against the platen 13 while causing the stop claw 12 to move away from the platen.

Figure 4:
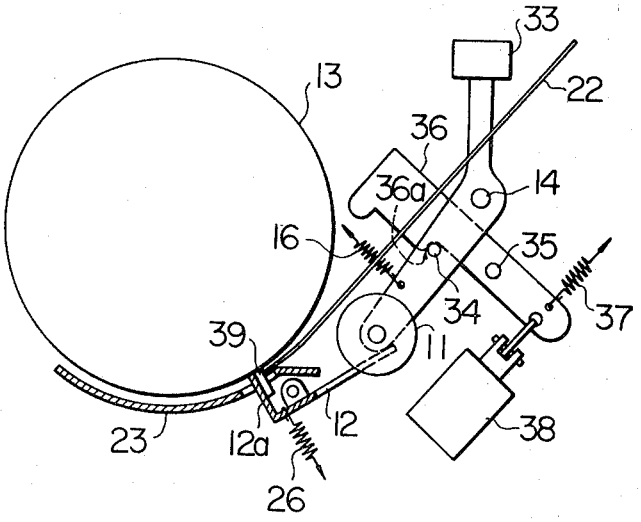
FIG. 4 is a schematic view of a paper loading apparatus according to yet another embodiment of the invention.

FIG. 4 shows still another embodiment of the invention. In the previous embodiments, the movement of the paper retaining roller away from the platen and the movement of the stop claw into abutment against the platen take place automatically in response to a detection signal while the termination of such movements is achieved by a manual operation. It will be recognized that paper used in such recording apparatus generally has a reduced rigidity. Hence, to terminate these movements, one of the hands which have been used to hold the opposite ends of the paper must be removed therefrom, and this may cause a displacement of the paper from the parallelism achieved if the paper has a reduced rigidity. To avoid this difficulty, in the apparatus shown in FIG. 4, an initial operation is manually performed while a subsequent termination is automatically performed, allowing both of the hands to be used to hold the paper to prevent it from being displaced from the parallelism. Specifically, an arm which carries the paper retaining roller 11 is formed by an operating lever 33 having a pin 34 which is adapted to engage a step 36*a*, formed in one lateral edge of another operating lever 36 which is pivotally mounted on a pin 35. The operating lever 36 is urged by a spring 37 to move counterclockwise while a solenoid 38 causes operating lever 36 to move clockwise through a small stroke against the resilience of the spring 37. The solenoid 38 is connected to a detector 39 which is mounted on the hook end 12*a* of a stop claw 2. The detector 39 is shown as a single element, but in practice, a plurality of such detectors are spaced apart axially of the platen 13. It is to be noted that these detectors 39 are coupled to an AND circuit, the output of which is connected to the solenoid 38 so that the latter can be energized when every detector is actuated. In operation, the operating lever 33 is turned to the left initially, causing the pin 34 to engage the step 36*a* and thus moving the roller 11 away from the platen 13 while allowing the stop claw 12 to abut against the platen. The members are maintained in these positions. Subsequently, paper 22 is inserted until its leading edge bears against the hook end 12 of the stop claw 12. When the leading edge of the paper 22 actuates the detectors 39, which are disposed on the hook end of the stop claw, the parallelism of the paper 22 will be achieved when every detector is actuated. At this time, the solenoid 38 is momentarily energized to disengage the step 36*a* from the pin 34, allowing the roller 11 to abut against the platen 13 while causing the stop claw 12 to be moved away from the platen 13.

When the leading edge of the paper is brought into bearing relationship with the stop claw in order to achieve the parallelism of the paper, it will be appreciated that a gap will be produced between the hook end of the stop claw and the peripheral surface of the platen unless the edge of the hook end and the peripheral surface of the platen are perfectly straight and parallel to each other. Such gap, if present, will permit the leading edge of the paper to extend thereinto, preventing the parallelism of the paper from being achieved. Alternatively, such gap may interfere with a proper achievement of the positioning of the paper in the axial direction of the platen. It will be understood that a machining and an assembly of an increased accuracy is required to form the edge of the hook end of the stop claw and the peripheral surface of the platen to be perfectly straight and parallel to each other, causing an increased manufacturing cost. To avoid this difficulty, the peripheral surface of the platen may be formed with a plurality of axially displaced annular grooves while the hook end of the stop claw may be formed with a plurality of protuberances which are adapted to be received in these grooves, so that when the paper is to be loaded, the protuberances extend into the grooves in the platen. When so arranged, the leading edge of the paper inserted will be engaged by the hook end of the stop claw and cannot extend beyond the hook end, thus facilitating the achievement of the parallelism and the positioning of the paper in the axial direction of the platen.

Figure 5:
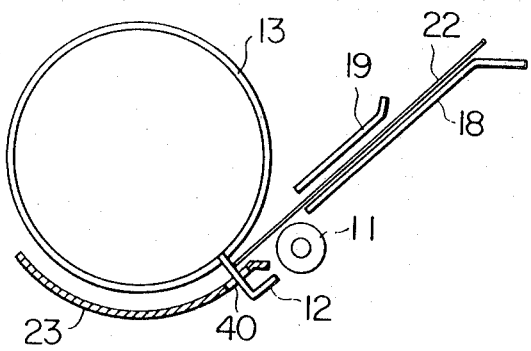
FIG. 5 is a schematic view of essential parts of a paper loading apparatus according to a still further embodiment of the invention.
Figure 6:
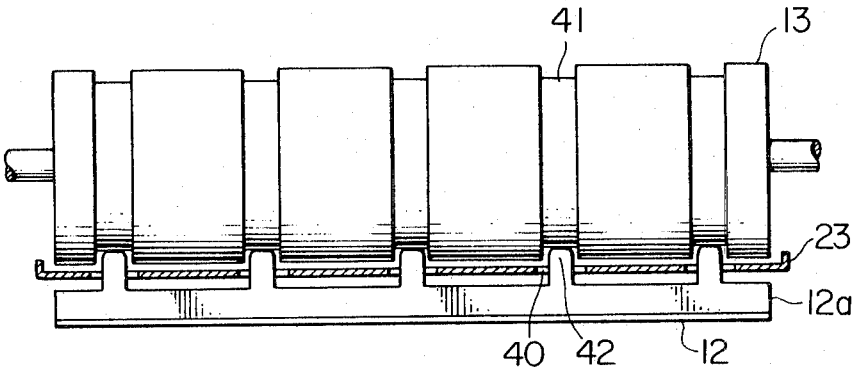
FIG. 6 is a plan view illustrating a platen and a stop claw used in the arrangement of FIG. 5.

Such an embodiment is shown in FIG. 5 where it will be noted that paper 22 is inserted into the space between guide plates 18, 19 until its leading edge bears against a stop claw 12, whereby its further movement is prevented. A guide plate 23 is disposed to extend around a platen 13, and is formed with an opening 40 through which the stop claw 12 is movable toward or away from the surface of the platen 13. As shown in FIG. 6, the platen 13 is formed with a plurality of axially spaced annular grooves 41 extending in a direction perpendicular to the axis thereof, and the hook end of the stop claw 12 is formed with a plurality of protuberances 42 which can be received in the grooves 41. The grooves 41 may be of any configuration provided they can receive protuberances, while the protuberances 42 may have any configuration which can be received in these grooves.

When the paper 22 is inserted into the space between the guide plates 18, 19, the protuberances 42 on the hook end of the stop claw 12 extends into the grooves 41 formed in the platen 13, and the roller 11 is removed from the surface of the platen 13. As before, the paper retaining roller 11 is disposed to be movable toward or away from the surface of the platen, and is movable independently from on in interlocked relationship with the stop claw. Specifically, its movement is controlled so that it is away from the platen 13 when the stop claw 12 abuts against the platen 13 while it abuts against the platen 13 when the stop claw 12 is away from the platen 13. Since the protuberances 42 on the hook end of the stop claw are received in the grooves 41 formed in the platen, it is assured that the leading edge of the paper 22 inserted be engaged by these protuberances, which prevent its further movement. Accordingly, if the free edge of the stop claw 12 is machined to be parallel to the axis of the platen 13 and the leading edge of the paper 22 bears uniformly against the hook end of the stop claw, it is assured that the leading edge of the paper 22 be maintained parallel to the axis of the platen 13 while simultaneously facilitating the positioning of the paper 22 in the axial direction of the platen.

This embodiment is particularly adapted to be used with a non-impact recording technique such as an ink jet process which does not rely on impacting with a type because the platen is formed with the plurality of grooves. However, if an arrangement is made such that suitable members fill the spaces within the grooves to define a smooth platen surface in the operative position, the described arrangement is equally applicable to impact recording apparatus.

While several embodiments of the invention have been specifically shown and described, it should be understood that a number of changes and modifications are possible therein. Therefore, it is intended that all such changes and modifications as fall within the spirit and scope of the invention as defined by the appended claims are covered by the present invention.

What is claimed is:

1. A paper loading apparatus including a platen, a paper retaining roller and a stop claw having protuberances formed on its free end, the roller and stop claw being movable relative to the surface of the platen in mutually opposite directions, the platen being formed with a plurality of axially spaced annular grooves in its periphery aligned with said protuberances, paper to be loaded being inserted into the apparatus when the paper retaining roller is removed from the surface of the platen and the stop claw protuberances abut with the aligned grooves of the platen until the leading edge of the paper inserted bears against the stop claw protuberances to achieve parallelism of the paper with respect to the platen as the paper is positioned axially of the platen, means moving the stop claw away from the platen when the paper retaining roller is brought into abutment against the surface of the platen; detection means for detecting the insertion of the paper into the apparatus, and motor means connected to said paper retaining roller and responsive to a signal from the detection means for automatically initiating the movement of the paper retaining roller and of the stop claw relative to the surface of the plate; the stop claw and the paper retaining roller being mechanically connected, the movement of the stop claw relative to the platen being responsive to the movement of the paper retaining roller relative to the platen, said motor means being one solenoid, the signal from the detection means energizing said solenoid to thereby move the paper retaining roller away from the platen and, through said connecting means, simultaneously cause the stop claw to move toward the platen.

* * * * *